United States Patent [19]

Caldwell et al.

[11] Patent Number: 4,621,693

[45] Date of Patent: Nov. 11, 1986

[54] APPARATUS AND METHODS FOR PUMPING SOLIDS AND UNDESIRABLE LIQUIDS FROM A WELL BORE

[75] Inventors: Donald B. Caldwell, Enid; Robert J. Spring, Oklahoma City, both of Okla.

[73] Assignee: The Adaptable Tool Company, Oklahoma City, Okla.

[21] Appl. No.: 750,050

[22] Filed: Jun. 26, 1985

Related U.S. Application Data

[63] Continuation of Ser. No. 491,309, May 3, 1983, abandoned.

[51] Int. Cl.[4] ..... E21B 37/00

[52] U.S. Cl. ..... 166/311; 166/105.1; 175/213

[58] Field of Search ..... 166/301, 311, 107, 109, 166/99, 105.1, 105.2–105.4; 175/65, 213, 234, 308

[56] References Cited

U.S. PATENT DOCUMENTS

| | | | |
|---|---|---|---|
| 1,300,346 | 4/1919 | Church | 166/109 |
| 2,099,877 | 11/1937 | Westall | 166/109 |
| 2,141,672 | 12/1938 | Taylor | 166/109 |
| 3,406,757 | 10/1968 | Baumstimler | 166/99 |
| 3,651,867 | 3/1972 | Baumstimler | 166/99 |
| 3,697,194 | 10/1972 | Holmes | 166/109 |
| 4,190,113 | 2/1980 | Harrison | 166/311 |
| 4,421,182 | 12/1983 | Moody et al. | 166/105.1 |
| 4,478,285 | 10/1984 | Caldwell | 166/105.1 |

*Primary Examiner*—Stephen J. Novosad
*Assistant Examiner*—Bruce Kisliuk
*Attorney, Agent, or Firm*—Laney, Dougherty, Hessin, Claro & Beavers

[57] ABSTRACT

An apparatus and methods for removing sand and debris from a well bore utilizes an elongated string which includes a pump functioning to pump debris into the string interior from the lower end of the well bore. The pump includes a stationary hollow piston with a hollow piston rod which is connected to the lower portion of the string, and a cylinder which is connected to the upper portion of the string. The cylinder is keyed to the piston rod to transmit rotary motion from the upper portion of the string via the pump to a lower portion of the string in which the debris is trapped. Check valves are provided below and above the pump in the string to prevent retrograde flow of liquid downwardly in the string. By reciprocating the upper portion of the string, debris is pumped into the lower portion of the string, along with well liquids. The liquid pumped into the string from the well continues upwardly in the string, passing through the interior of the piston rod and piston and into the pump cylinder. The upper portion of the string selectively receives either a ported sub or a continuous unported sub so that, depending upon the sub utilized, the liquid can be recirculated back into the annulus surrounding the string within the well bore, or can be pumped to the surface.

12 Claims, 6 Drawing Figures

APPARATUS AND METHODS FOR PUMPING SOLIDS AND UNDESIRABLE LIQUIDS FROM A WELL BORE

This application is a continuation of application Ser. No. 491,309, filed May 3, 1983, now abandoned.

BACKGROUND OF THE INVENTION

1. Field of the Invention

This invention relates to apparatus and methods by which undesirable materials can be removed from the lower portion of a well bore, such undesirable materials including sludge, plugs, contaminated or corrosive water and sand.

2. Brief Description of the Prior Art

Sand pumps have long been used to remove sand and other solid debris from wells. Such pumps are lowered into the well on a wire line and are operated by connection of the wire line to a piston rod. The wire line is reciprocated to operate pump. Check valves are provided in the sand pumps to prevent retrograde flow back into the well during the lifting stroke of the pump. A wire line operated sand pump is limited because of the limited motion which can be imparted to the pump through the flexible wire line.

Another type of down hole tool for capturing sand, fish, propping solids and contaminated liquids is that which is described in U.S. Pat. No. 4,190,113 to Harrison. The Harrison tool is operated by a rigid string extended to a pumping device from the surface and used to impart both rotary and reciprocating movement to the tool. A pump is incorporated in the elongated string extended downwardly into well bore from the surface, and is operated by reciprocating the upper portion of the elongated string to cause liquid and solid debris to pass into the lower portion of the tool. Here the solid portion of the debris is trapped due to density difference and the liquid portion continues to move upwardly during the pumping stroke. The liquid passes through the piston, and is pumped through ports located above the piston and communicating with the annulus around the tool. In this way, the liquid is returned to the well bore after the solid debris has been separated therefrom.

The tool described in the Harrison patent is characterized by a less than optimum service life because, where corrosive liquids are pumped from the well bore, the liquid surrounds the piston rod and contacts the cylinder walls causing corrosion thereof and early weakening. Further, in returning the pumped liquid to the well bore, tha Harrison tool makes no provision for those cases where the liquid is so caustic or corrosive that it would be desirable to remove it entirely from the well by pumping it or removing it to the surface.

The Harrison tool is also susceptible to high pressure gas unloading of the debris collected in the debris retaining chamber at the lower portion of the tool. This occurs where high pressure gas is present in the well bore and develops sufficient pressure under the collected debris to force it explosively upwardly through the pump and back out of the ports which communicate the interior of the pump cylinder with the well bore. Where this occurs, the efficiency of the pump in collecting debris is obviously drastically lowered, and equally importantly, the forcing of the sand upwardly through the pump erodes the pump and valve surfaces and tends to cause fouling of the pump.

Caldwell U.S. patent application Ser. No. 342,369 describes an improved down hole tool and method of using that tool, which function effectively in the removal of either or both solid debris and corrosive liquids from the well bore, while including an effective pumping structure with a much increased operating life as compared to other similar tools. Like the Harrison tool, however, the debris removal tool described in said copending patent application includes a check valve mounted in the piston forming a part of a pump included in an elongated string which carries the tool, and such piston mounted valve is also susceptible to rapid wear due to the high velocity passage of pumped liquid upwardly in the tool. Erosion and corrosion of the valve element carried in the piston is especially pronounced where highly corrosive liquid is present in the well bore and is pumped upwardly. Further, and as compared to the present invention, where any solid particles are entrained with the liquid which passes upwardly through the hollow piston and piston rod disclosed in the copending application, a tendency exists to erode away the inlet to the hollow piston, and to damage the check valve carried therein.

GENERAL DESCRIPTION OF THE PRESENT INVENTION

The present invention provides an improved downhole tool useful for baling out the well by removing said, dirt, trash, pieces of metal, propping agents, caustic water and other undesirable materials from the well bore. The tool is a mechanically simple device, having a minimum number of moving parts and valves susceptible to malfunctioning. The tool operates on the basis and principle of separating solids from liquids and disposing of each in an efficient manner.

Broadly described, the apparatus of the invention comprises an elongated string of metallic or other rigid structural members which are interconnected in sections and dimensioned for extension downwardly into a well bore in the earth. The string is of a length such that the location of the debris and other material to be removed from the well is reached by the lower end of the string. The string includes an upper portion which can be solid or tubular, but which has sufficient mechanical strength that both rotary and reciprocating motions can be imparted to the lower portion of the string via the upper portion. Thus, the present invention avoids the use of wire lines or other flexible members in order to attain a driving and actuating capability which permits both rotary and reciprocating movement to be imparted to a pump and cutting or reaming elements, and other structures which are included in the string in the lower portion thereof.

More specifically, the present invention comprises a series of elongated, threadedly interconnected tubular or solid rod sections extendable from the surface downwardly into the well, with the lower end of the interconnected elements connected to a tubular liquid receiving sub which is located above a tubular sub containing an upper check valve. The check valve containing tubular sub is connected by a suitable connector subassembly to the upper end of the cylinder of a reciprocating pump. The reciprocating pump further includes a stationary piston having a piston rod extending downwardly therefrom through the lower end of the cylinder and connected at its lower end to a connector section which connects the piston rod to a solids or debris collecting and retaining chamber. Connected below the solids collecting chamber in the string is a standing valve sub, and below that is a bottom sub. A bore is formed through the piston and piston rod to permit liquid to be pumped upwardly into the liquid chamber above the upper check valve. A second check valve is preferably located at the upper end of, or above, the solids collecting chamber.

In operation, the cylinder of the pump is reciprocated from the surface by means of the interconnecting elements of the string, and this causes both liquids and solids to enter the bottom sub, and then to pass through the standing valve sub and into the solids retaining chamber. At this location, the solids tend to settle out as the liquid is pumped further upwardly in the string. The liquid passes upwardly in the string through the passageway formed through the piston and piston rod and ultimately enters the liquid chamber above the upper check valve. From this point, the liquid may be ported to the annulus and thus returned to the well bore, or it may be retained until the entire tool is removed from the well, or, by continuing the pumping action, the liquid can be pumped to the surface. The connection between the upper portion of the string and the lower portion, via the pump included in the string, is such that rotation of the string at its upper end is transmitted through the string to the lower end of the string.

An important object of the present invention is to provide a well clean out tool which, by reason of its construction, prevents dumping of the liquid and solid load which has been pumped as a result of the occurrence of a build up in gas pressure at the lower end of the clean out tool.

A further object of the invention is to provide a method and apparatus for removing debris from the lower end of a well bore in such manner that the solids can be isolated and the liquids optionally either returned to the well bore or pumped to the surface.

A further object of the invention is to provide an improved well clean out tool which employs a minimum number of valves located so that the valves are susceptible to minimal fouling and erosion over an extended service life of the tool, and so that the few valves used are readily accessible.

An additional and further object of the invention is to provide a well clean out tool which can be manipulated from the surface in a reciprocating, as well as in a rotary motion, so as to prevent sticking of the tool, and to permit the tool to be used for reaming and other secondary operations and functions, in addition to its well clean out function.

Another object of the invention is to provide a well clean out tool which does not require the inclusion of any feathering sub in the lower portion of the string.

Other objects and advantages of the invention will be become apparent as the following detailed description of the invention is read in conjunction with the accompanying drawings which illustrate a preferred embodiment of the invention.

GENERAL DESCRIPTION OF THE DRAWINGS

DESCRIPTION OF THE PREFERRED EMBODIMENT OF THE INVENTION

Figure 1:
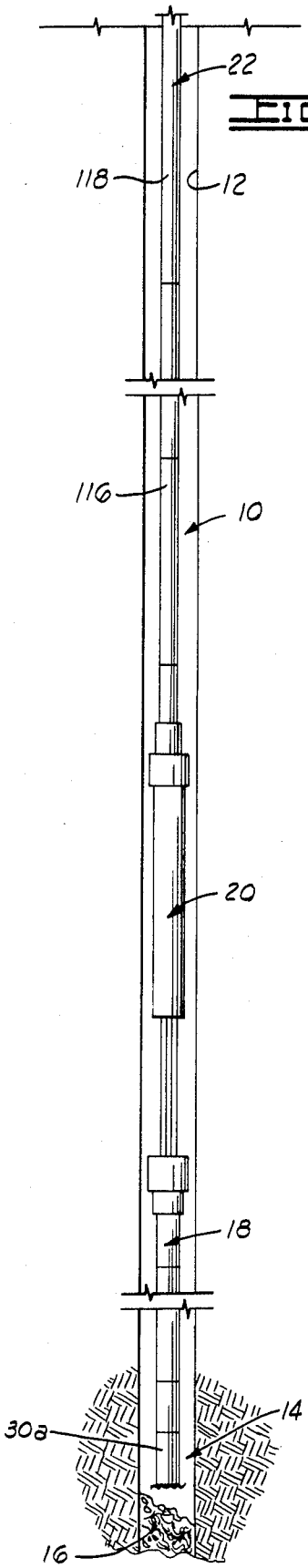
FIG. 1 is a partial, front elevational view of one embodiment of the present invention as it appears when operatively disposed in a well bore.

Referring to the drawings, a generally tubular relatively rigid string 10, shown in FIG. 1, is positioned within a well 12. The upper end of the string 10 is connected to a conventional surface workover rig (not shown) for axially reciprocating the string in the well 12, and for rotating the string about its vertical axis. The string has a down hole end 14 located adjacent solid well debris 16. The string 10 includes a debris retaining portion or chamber 18, a pumping portion 20 and an upper portion 22 connectable to a surface rig (not shown).

Figure 2:
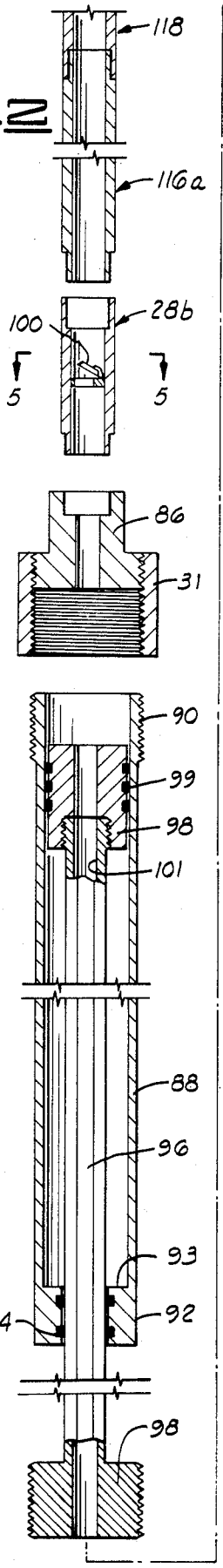
FIG. 2 is an enlarged, exploded view partially cross-sectioned along a central vertical plane through the apparatus shown in FIG. 1.

As shown in FIG. 2, the debris retaining portion 18 includes a feathering sub 24, a solid debris collecting sub 26, a standing valve sub **28*a*, and a debris engaging bottom sub 30*a*. Each of the subs 24 through 30*a* is threadedly connected to its adjacent sub to enable selective arrangement, removal, and replacement of the various subs forming the portion 18**.

The feathering sub 24 includes an upper threaded collar 32 and a threaded, apertured plug 34. An elongate bore 36 extends centrally through the plug 34. The diameter of the bore 36 is considerably less than the internal diameter of the adjacent portions of the string 10.

In the tool of the present invention, the inclusion of the feathering sub 24 in the string 10 is optional, since the particular arrangement of the piston, piston rod and cylinder permits the usual functions of the feathering sub to be assumed by the hollow piston rod and piston.

The solid debris collecting sub 26 carries a pair of threaded ends 38 and 40. The threaded end 38 is securable to a threaded end of a lower check valve sub 39 which carries a check valve 41 and is connected to the threaded end 42 of the plug 34. The threaded end 40 of sub 26, is releasably securable to the threaded end 44 of the valve sub **28*a*. The column of the solid debris from the well 12 may be as long as 300 feet in length. In order to remove as much of the entire debris load as possible in a single trip into the well, the sub 26 may be up to 1500 feet in length. However, the length of the sub 26 is controlled by the amount of liquid in the well because the pumping portion 20** must be within pumping distance of the fluid column.

Figure 5:
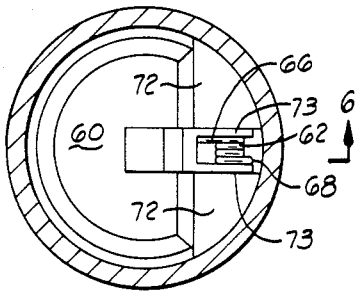
FIG. 5 is an enlarged cross-sectional view taken generally along either of the lines 5—5 in FIG. 2, the views being identical in either case.
Figure 6:
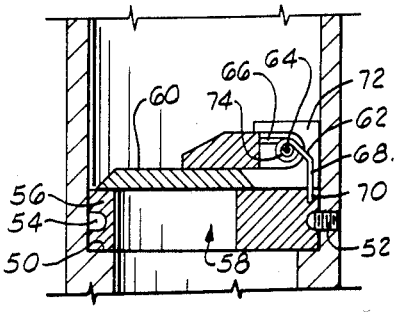
FIG. 6 is a cross-sectional view taken generally along the line 6—6 in FIG. 5.

The valve sub **28*a*, securable to the debris engaging sub 30*a* by its threaded end 46 and the threaded upper end 47 of the sub 30*a*, includes a check valve 48 which permits upward flow into the string 10 and prevents reverse flow out of the string 10. The valve 48 is preferably an upwardly opening flap valve. One highly advantageous valve for this purpose, shown in FIGS. 5 and 6, is removably located within the interior of the sub 28*a*. The valve 48 is supported on a ledge 50 formed in the interior surface of the sub 28*a*, and is retained against upward movement by a threaded fastener 52, conveniently a conventional set screw. engaging a peripheral annular depression 54 encircling the seat of the valve 48. The seat 56 forms an opening 58 closed by a pivoting flap element 60. The flap element 60 is biased to the closed position on the seat 56 by a torsion spring 62 encircling a pin 64 that pivotally mounts the flap element 60. One end 66 of the spring 62 is secured to the flap element 60 while the other end 68 is secured within an aperture 70 in the seat 56**.

Since the spring 62 is situated astride the opening 58 and over the seat 56, its exposure to liquid flow through the sub 28 is minimized. Further protection against contamination is provided to the spring 62 and pin 64 by the upwardly directed flanges 72 located to either side of the spring 62, connected to the seat 56, and by the lateral tabs 73 of the element 60 that receive the pin 64 and sandwich the spring 62 between themselves. A tubular bushing 74, encircled by the spring 62 as well as by the tabs 73 of the element 60, facilitates the action of the spring 62.

Figure 4:
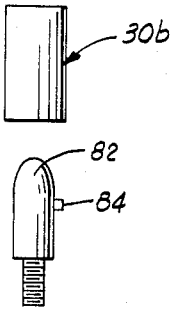
FIG. 4 is an exploded view of a fishing tool useful in connection with the embodiment shown in FIG. 1.

The debris engaging sub 30*a* includes an inlet 78 that admits water and debris 16 into the string 10. A variety of conventional debris engaging subs may be used as the sub 30*a*, depending on the intended use of the string 10. The drilling sub 30*a*, shown in FIG. 2, for example, includes a serrated lower edge 80 useful in grinding or drilling solid debris 16 to enable the particles to be sucked inwardly into the string 10. The retrieving sub 30*b* shown in FIG. 4, is useful for engaging and removing a lodged downhole fish 82 using a conventional engaging means (not shown) located in its interior. Upon downward movement and subsequent rotation of the string 10, the sub 30*b* engages and is locked onto the outwardly extending pin 84 of the fish 82. Any conventional debris engaging sub may be used in place of the illustrated subs 30*a* and 30*b* for drilling, milling, retrieving fish, collecting junk, supplying liquid, cleaning, swabbing, bailing or the like, all well known in the art.

Located atop the debris retaining portion 18, the pumping portion 20 includes connecting sub 86 and a collar 31 threadedly connecting a sub 86 to the threaded end 90 of a cylinder 88. The cylinder 88 includes a threaded upper end 90 engaging the collar 31 and a lower end 92 which carries a closure plug 93. The closure plug 93 has a pair of seals 94 extending around and sealingly engaging a polygonally cross-sectioned piston rod 96 (i.e. in the form of a splined shaft) which projects through the closure plug 93 at the lower end of the cylinder 88.

The piston rod 96 carries at its upward end, a piston element 98 which has sealing elements or piston rings 99 therearound. At its lower end, the piston rod 96 carries a threaded connector block 98 by which the piston rod is connected to the internally threaded collar 32. The collar 32 functions to connect the piston rod 96 to the plug 34. It will thus be perceived that the piston rod 96 and piston 98 are supported in stationary fashion at the upper end of the lower portion of the string which includes plug 34, the standing valve sub 28*a*, the debris collecting sub 26 and the debris engaging sub 30*a*.

It will be noted in referring to FIG. 2 that the piston 98 and piston rod 96 define a continuous elongated bore which a forms a fluid flow passageway through the entire length of the piston rod and through the piston. Further, the piston is free of, and does not contain, any check valve. It will further be noted that liquid jetting forcibly upwardly from the feathering sub 24 during the pumping operation as hereinafter described, does not impinge upon the lower face of the piston of the pump, as in the tool described in Caldwell copending application Ser. No. 342,369.

The sub 86 is connected at its upper end to an upper valve sub 28*b* which is substantially identical to the traveling valve sub 28*a* secured to the bottom of the debris collecting sub 26. The upper valve sub 28*b* thus contains a check valve 100 of the flapper type.

Figure 3:
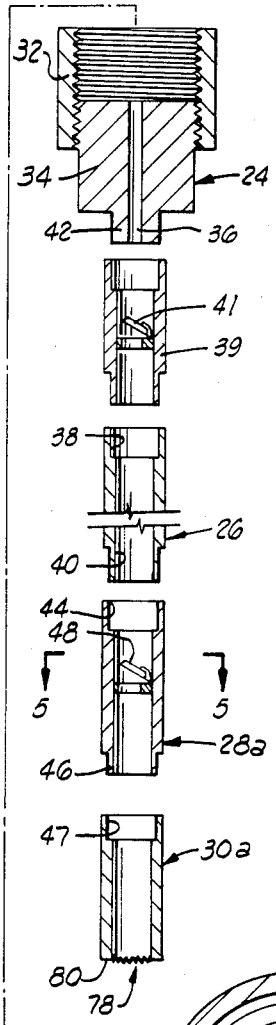
FIG. 3 is a front elevational view of a ported sub useful in the embodiment shown in FIG. 1.
Figure 3:
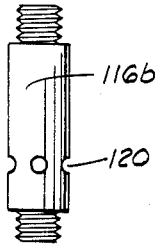

Reciprocation of the cylinder 88 upon the piston 96 causes fluid to be pumped from the well 12 upwardly through the debris retaining portion 18 and upwardly through the pumping portion 20 of the string. The upper portion 22 of the string includes a liquid receiving sub 116 which is threadedly connected at its lower end to the adjacent upper valve sub 28*b*, and its upper end to the remaining portion of the string 10 which, in the illustrated embodiment, is in the form of tubing 118. As illustrated in FIG. 2, the liquid receiving sub 116 may take the form of a closed cylinder 116*a* that receives liquid which passes upwardly through the cylinder 88 of the pumping portion 20. The liquid receiving sub 116*a* receives and retains liquid above the upper valve sub 28*b* which checks retrograde flow of the liquid downwardly from the liquid receiving sub. As pointed out in copending patent application Ser. No. 342,369, the liquid receiving sub 116*a* can be replaced with a ported liquid receiving sub 116*b*, of the type shown in FIG. 3, in which case the liquid is expelled through a plurality of radial openings 120 and is thereby returned to the annulus surrounding the tool.

In the use and operation of the tool of the invention, the string 10 is first lowered into the well 12 until the lower end 14 of the string contacts debris 16 which is to be removed from the well. When the lower end 14 of the string 10 contacts the solid debris 16, the upper portion 22 of the string 10 is reciprocated by the use of conventional apparatus (not shown) located at the surface. Reciprocation of the upper portion of the string 10 is transmitted to the cylinder 88 through the sub 86 and collar 31. As a result, the cylinder 88 is reciprocated upon the piston 98. Due to the masses of the piston 98, rod 96 and debris retaining section 18; the piston 98 and piston rod 96 remain stationary with respect to the cylinder 88.

Reciprocation of the cylinder 88 on the piston 98 causes suction to be created during in the upstroke of the cylinder 88 so that liquid in the well bore is drawn upwardly into the debris retaining portion 18 through the inlet 78. A substantial amount of solid debris enters the debris retaining portion with this liquid. At this time, the suction has also opened the check valve 48 in the lower valve sub 28*a*. At this same time, the upper check valve 100 is closed.

The length of the debris collecting sub 26 permits the solid materials constituting the debris to settle by gravity from the liquid concurrently drawn into the tool from the well bore. The liquid moves upwardly through the lower check valve sub 39, and continues upwardly through the feathering sub 24 where one is included in the string. As the liquid passes through the small diameter elongated bore 36 through the feathering sub 34, an upwardly directed force is applied to the string to prevent the string from being sucked downwardly into the debris and becoming stuck. The liquid continues upwardly into the elongated piston rod 96 and the liquid passes through the elongated continuous bore or passageway 101 through the piston rod and through the piston 98.

An advantage of the present invention is that the liquid which is jetted upwardly with considerable force from the bore 36 through the feathering sub 24 does not impinge upon the lower face of the piston 98 as such inpingement occurs in the case of the tool illustrated and described in Caldwell copending application Ser. No. 342,369. Since this liquid can often be of a corrosive character, and frequently carries sand, or other small abrasive particles not separated out, the present construction obviates wear of the piston face and ealy loss of sealing integrity of the piston rings 99. The same advantage obtains, of course, where the feathering sub is entirely eliminated from the string.

After the cylinder 88 has been lifted upwardly by upward reciprocation of the upper portion 22 of the string 10, the upper portion 22 of the string and the cylinder 88 attached thereto are moved downwardly. Attachment of the cylinder 88 to the reciprocated upper portion of the string 10 provides a further improvement over prior tools because of the greater gravitational aid to pumping which the attached cylinder affords, as compared to a piston and piston rod. Downward movement of the cylinder 88 causes the piston 96 to force the liquid above the piston in the upper end of the cylinder to move upwardly through the sub 86 and through the check valve 100 in the upper check valve sub **28*b* which is forced open at this time. This same movement of the cylinder 88 in downward reciprocation closes the lower check valve 41 and the standing check valve 48 in the lower standing valve sub 28*a*, thereby preventing the accumulated solid debris from being ejected from the string 10** back into the well bore.

After passage through the check valve 100 in the upper valve sub **28*b*, the liquid is received into the liquid receiving sub 116*a*. Upon cessation of pumping, and/or during the upstroke of the cylinder 88, the liquid is trapped in the liquid receiving sub 116*a* due to closure of the check valve 100 in the upper check valve sub 28*b***.

Optionally, instead of using an unported liquid receiving sub **116*a* of the type illustrated in FIG. 2, a ported sub 116*b* can be included in the string 10 in order to recirculate the pumped liquid into the well bore. When contaminated liquid is pumped, and it is desired to remove it from the well, however, this may be done by employing the unported sub 116*a*, and either pumping the liquid to the surface, or allowing it to accumulate in the unported liquid receiving sub 116*a*** until the entire tool, including the entrapped contaminated liquid, is removed from the well bore.

Due to the keyed cooperation of piston rod 96 (which is of ploygonal cross-sectional configuration) and the bore formed through the closure plug 93, rotary motion can be imparted to the entire string 10 from top to bottom by the use of a rotary motion developing apparatus located at the surface. Where a bottom sub **30*a* having a serrated lower surface 80 is utilized, this rotary motion will permit grinding or reaming of the debris 16, thereby making it possible to subsequently suck the debris more easily into the string 10. Alternatively, the sub 30*a* may be replaced by a fishing sub 30*b*, and the rotary motion used to engage the fishing sub with a fish, such as the fish 82 which is shown in FIG. 4**. Subs having other functional capabilities can also be placed on the lower end of the string.

If a gas pocket is encountered during a debris removing operation, the contents of both the liquid receiving sub 116 and the solid debris collecting sub 26 are retained within the tool through the use of the unported sub **116*a*. The high pressure gas may blow the solid debris contained in the debris retaining portion upwardly through the pumping portion 20 to collect within the liquid receiving sub 116*a*. Since this sub is unported, however, the solid debris is prevented from returning to the bore hole. In the present invention, the passage of the debris through the pumping portion 20 is accomplished by way of the unobstructed passageway 101 through the piston rod 96 and piston 98**, and in transiting this passageway, the debris does not encounter any valve which would be thereby subjected to severe erosion and possible jamming in the open position or blockage.

Either a manual or hydraulic jar can be developed using the tool of the present invention. A jarring element is shown as closure plug 93. The jar is produced by forcible contact of the closure plug 93 at the lower end of the cylinder 88 with the lower side of the piston 98 at the end of the upward stroke of the cylinder 88. The hydraulic jar is produced by pulling the closed lower end 92 of the cylinder 88 against the piston 98, resiliently stretching the string 10, and suddenly releasing this tension, thus producing a fluid surge. Such jarring actions are employed to prevent sticking of the string 10, or freeing it in the event it becomes stuck in the debris.

Although a preferred embodiment of the present invention has been herein described in order to impart to those skilled in the art an understanding of the working principles which underlie the invention, it will be appreciated that various changes and innovations can be made in the described structure without departure from reliance on these principles. Changes and innovations of this type are therefore deemed to be circumscribed by the spirit and scope of the present invention, except as the same may be necessarily limited by the appended claims or reasonable equivalents thereof.

What is claimed is:

1. An apparatus for removing debris, including solids and liquids, from a well bore comprising:

a vertically extending elongate string connectable to a source of reciprocating and rotating motion and having an open lower end, the string including:

a debris retaining portion having an outlet and an inlet;

a debris retaining check valve positioned below said debris retaining portion to close said inlet;

a downhole pump in fluid communication with the outlet of said debris retaining portion, said downhole pump including a cylinder, a ported piston and a hollow piston rod, said piston connected by said hollow piston rod to the outlet of said debris retaining portion, and said cylinder retained in said elongate string for reciprocation upwardly and downwardly around said piston at a time when said piston and the debris retaining portion connected thereto by said hollow piston rod rest upon, or are in contact with, solids-containing debris located immediately therebelow, said cylinder including a lower end slidably engaging said piston rod and keyed to said piston rod for mutual and concurrent rotary motion with said piston rod about the longitudinal axis of the piston rod whereby, when said cylinder undergoes rotary motion, such rotary motion is imparted to said hollow piston rod;

an upper portion of said string communicating with said pump and connectable to said source of reciprocating and rotating motion at the upper end of said upper portion of said string, and to said cylinder at the lower end of said upper portion of said string, said cylinder having a lower end portion slidably engaged with, and keyed to, said piston rod to communicate a rotating motion of said upper portion via said piston rod to said debris retaining portion located below said downhole pump;

said piston rod and piston including an internal elongated passageway open and unobstructed from one end thereof to the other and establishing fluid communication between the upper end portion of said cylinder and said debris retaining portion;

a second check valve located above said piston and above said cylinder in said upper portion of said string for permitting flow through said passageway, through said ported piston, through said cylinder, and through said second check valve into said upper portion of said string at a location above said second check valve, and to prevent fluid flow in the reverse direction; and a liquid chamber connected to the upper end of said cylinder and located over said pump and in fluid communication with said unobstructed passageway for collecting liquid pumped upwardly by said pump, said liquid chamber being detachably and removably connected in said elongate string.

2. The apparatus defined in claim 1 and further characterized as including a sub removably connected to the upper end of said cylinder in fluid communication with the passageway through said piston and piston rod, and having radial ports formed therethrough for return of pumped fluid to a well bore around said elongate string.

3. The apparatus defined in claim 1 and further characterized to include a feathering sub connected between the outlet of said debris retaining portion and said piston rod and having a passageway of reduced diameter extending therethrough and aligned with the internal passageway through said piston rod and said ported piston for supplying an upward force to said string in response to passage of liquid through the reduced diameter passageway through said feathering sub and into said internal passageway in said piston rod at the location where said piston rod is connected to said feathering sub.

4. The apparatus defined in claim 1 wherein said cylinder includes a jarring element such as a closure plug adapted for contact with said piston for jarring said debris retaining portion upon upward reciprocation of said cylinder.

5. The apparatus defined in claim 1 wherein said liquid chamber defines a plurality of radial ports formed therethrough to facilitate the return of pumped fluid to a well bore around said elongate string.

6. An apparatus as described in claim 1 wherein said vertically extending elongate string is further characterized as including an uninterrupted, tubular lower portion extending from said debris retaining portion downwardly to the lower end of the elongate string, said tubular lower portion having an axially extending fluid flow passageway therein extending from said debris retaining portion to the open lower end of said elongate string, said debris retaining check valve being positioned in said axially extending fluid flow passageway, said tubular lower portion having no radial ports or radial passageways passing therethrough, whereby vacuum developed by said pump acts without diminution through said axially extending fluid flow passageway to said opening at the lower end of said elongate string.

7. An apparatus as defined in claim 1 and further characterized as including a third check valve disposed above said debris retaining portion in said elongate string and below said downhole pump, said third check valve preventing fluid flow from said downhole pump toward said debris retaining portion.

8. A method for removing debris having a solid component and a liquid component from deep in a well bore comprising:

assembling an elongated tool string dimensioned for extension into the well bore, said tool string including a tubular lower debris collecting portion, an upper portion, and a pump disposed between said debris collecting portion and said upper portion, said pump including:

a hollow piston rod having a lower end connected to the upper end portion of said lower debris collecting portion, and having an upper end;

a piston connected to the upper end of said piston rod and having an opening therethrough aligned with the hollow interior of said hollow piston rod for receiving fluid from said hollow piston rod; and a cylinder slidingly enclosing said piston, and having an upper end portion connected to said tool string upper portion for moving up and down in said well bore with said upper portion, and for rotation within said well bore about the axis of said well bore with said tool string upper portion;

extending the elongated string as thus assembled into said well bore until the lower debris collecting portion disposed at the lower end of the string is in the debris;

reciprocating the upper portion of the tool string with respect to the debris collecting portion to cause movement of said cylinder up and down while the piston contained therein remains stationary to thereby pump the debris from the well into the debris collecting portion;

continuing to reciprocate the upper portion of the string with respect to the debris collecting portion to thereby pass the liquid component of the debris through the piston rod and piston and then into the upper portion of said cylinder above said piston, and then from said cylinder into said tool string upper portion;

periodically rotating the tool string to loosen the debris outside of, and at the lower end of, said tool string; and elevating the upper portion of said tool string periodically by an amount to bring the lower end portion of said cylinder into forceable contact with said stationary piston as said cylinder is moved upwardly, and thereby break free said relatively low mass, which includes said piston, hollow piston rod and debris collecting portion, from said debris by imparting a jarring motion in an upward direction to said piston, piston rod and lower debris collecting portion.

9. The method defined in claim 8 including the step of placing a chamber in said string above said pump cylinder.

10. The method defined in claim 9 including the step of pumping liquid from said chamber to the surface.

11. The method defined in claim 9 including the step of holding liquid within said chamber and subsequently lifting said string and said liquid from the well.

12. A method for removing downhole well debris including mixed liquid and solid particles, from a well bore hole, said method comprising:

making up an elongated tubing string which comprises a lower tubular assembly which includes:

a debris retaining chamber for receiving and retaining debris from the bore hole;

a valve positioned to facilitate one-way flow of debris into the debris retaining chamber from the well bore adjacent the lower end of the tubing string, while preventing retrograde flow in the opposite direction;

an upper tubular assembly which includes:

a portion at the upper end thereof connectable to a source of reciprocating and rotary motion;

a portion at the lower end thereof defining a fluid containing chamber;

a pumping assembly connected between said upper tubular assembly and said lower tubular assembly, said pumping assembly including:

an elongated, hollow piston rod having a passageway extending axially therethrough from one end to the other;

a piston connected to one end of the piston rod and having a fluid flow port therethrough communicating with the passageway through the positon rod; and an elongated cylinder slidably surrounding said piston and a portion of said piston rod;

lowering the elongated tubing string as thus made up in the well bore until said lower tubular portion is located therein to position the lower end of the tubing string in proximity to the debris to be removed, with said debris retaining chamber positioned up-hole therefrom; then reciprocating said upper tubular assembly of said elongated tubing string to thereby actuate said pump to move said piston and elongated cylinder relative to each other, and to thereby pump fluid upwardly through said elongated hollow piston rod and debris through said valve and into said debris retaining chamber;

collecting solid particles from the debris in said debris retaining chamber; and at such time as may be required to improve operating efficiency, rotating the upper portion of the tubing string about the longitudinal axis thereof.

* * * * *